United States Patent [19]

Minasov et al.

[11] 4,163,694

[45] Aug. 7, 1979

[54] HEATING WALL FOR COKE OVENS

[76] Inventors: Alexandr N. Minasov, ulitsa Ivanova, 12/16, kv. 59; Evgeny P. Likhogub, ulitsa Slinka, 2, kv. 11; Stanislav S. Sergeev, ulitsa Kosmonavtov, 3, kv. 114, all of, Kharkov, U.S.S.R.

[21] Appl. No.: 882,207

[22] Filed: Feb. 27, 1978

[51] Int. Cl.[2] ..... C10B 5/04

[52] U.S. Cl. ..... 202/139; 110/163; 138/39; 138/45

[58] Field of Search ..... 202/138–141; 432/180, 181; 110/163; 138/39, 45 A

[56] References Cited

U.S. PATENT DOCUMENTS

| | | | |
|---|---|---|---|
| 1,319,842 | 10/1919 | Buhler | 202/144 |
| 1,678,803 | 7/1928 | Ackeren | 202/141 |
| 3,518,541 | 7/1970 | Schurhoff | 202/139 |
| 3,700,219 | 10/1972 | Jakobi | 202/139 X |
| 3,969,191 | 7/1976 | Bollenbach | 202/141 |

FOREIGN PATENT DOCUMENTS

| | | | |
|---|---|---|---|
| 752945 | 7/1970 | Belgium | 202/139 |

*Primary Examiner*—Arnold Turk

*Attorney, Agent, or Firm*—Haseltine, Lake & Waters

[57] ABSTRACT

A heating wall for coke ovens with horizontal coking chambers comprises vertical heating flues arranged in pairs, every pair of adjoining heating flues being separated by a partition formed with a flow port in the upper portion. Lateral sides of the flow port are provided with vertical slot-like guides which accommodate projections of a slide gate. The guides are formed in their upper portion with stepped recesses the vertical extent of which exceeds the length of the slide gate projections. The slide gate center of gravity is shifted with respect to the longitudinal axis of its projections in the direction opposite to the stepped recesses. The slide gate is provided with means for introducing a hook and vertically moving the slide gate into its uppermost and lowermost position in the flow port. As a result, the flow port vertical position is changed substantially without changing the clear opening of the flow port. This, in turn, changes the level at which combustion products flow from one vertical flue into the other, thus changing the temperature within the upper portion of the coking chamber.

3 Claims, 8 Drawing Figures

HEATING WALL FOR COKE OVENS

BACKGROUND OF THE INVENTION

1. Field of the Invention

The invention relates to coking industry, and more specifically to coke oven constructions having a horizontal coking chamber confined between two heating walls which comprise vertical heating flues arranged in pairs.

2. Description of the Prior Art

Modern coke ovens with horizontal coking chambers confined between heating walls which comprise vertical heating flues arranged in pairs are known to find ever increasing use in industry. Every pair of vertical flues is separated from the next pair by a blind partition. In turn, every pair of vertical flues is provided with a separating partition formed with a flow port at the top. The flow port is intended for passing combustion products from one vertical flue to the other. The separating partition is also provided with a recirculation orifice in the bottom portion.

In operation, gas and air are supplied to one vertical flue of every pair. Thus, combustion occurs simultaneously within half of the wall heating flues. Combustion products pass through the flow port from one flue into the other, i.e. adjoining vertical flue, flow downwards and out of the flue on the way to a checker chamber. A portion of combustion products returns through the recirculation orific into the vertical heating flue in which combustion takes place. Gas flow in the adjoining vertical heating flues periodically changes direction, i.e. combustion takes place alternately in one or the other flue, and accordingly combustion products are removed through the adjoining flue, a predetermined amount of combustion products being constantly passed through the flow port in one or the other direction.

Heat resulting from combustion is transferred to the oven coking chamber where coal charge is transformed into coke without air access.

In the process of coking coal charge shrinks. Depending on the granulometric and component composition of the coal charge and on coal resources base the coal charge shrinkage value varies. According to an anticipated coal charge shrinkage value the requisite heating level is selected for a specific coke oven battery, i.e. the distance between the coking chamber top and the flow port top. However, the resource base and coal are sometimes changed, and accordingly, the charge shrinkage value is changed which, with a constant heating level in a particular coke oven battery, causes under or overheating of the coke upper portion. This results in a deteriorated coke oven operating conditions and coke quality and in lower production rates.

Various procedures are resorted to in order to obviate the above shortcoming. Thus, when the coal charge shrinks beyond the rated heating level, the upper portion of the charge is additionally compressed with a planing rod, or the height of the space under the coking chamber roof is decreased by filling the chamber with excess coal charge, or the burners positioned in the heating wall vertical flues are lowered, or graphite deposits, on the coking chamber walls and roof are burned (with the oven empty), or an anarbitrary combination of the foregoing procedures is used, etc. All the above procedures are directed to the elimination of overheating of the coke cake upper portion and decreasing the temperature in the upper portion of the coking chamber.

If the coal charge shrinkage value is less than the rated one, the amount of coal charge in the coking chamber is decreased, or the duration of coking is increased, or both these procedures are used simultaneously.

However, the aforesaid measures are insufficiently effective and require extra operational costs.

To obviate the overheating or underheating of the coal charge, there have been attempts to provide a possibility of adjusting the heating level in a coke oven by improving the construction of heating walls.

Thus, known in the art is a coke oven with a horizontal coking chamber confined between heating walls which comprise vertical heating flues arranged in pairs, as disclosed in the German Pat. No. 677101 Nat. Class 10a/6. According to said Patent the upper portion of a partition separating adjoining vertical heating flues is formed with a flow port having a fixed bottom edge.

The cover of the vertical heating flues and the top portion of the separating partition forming the top edge of the flow port are detachable. The level of heating in the coke oven is to be adjusted by lowering the port top edge. To accomplish this a short upper portion of the partition is substituted by a longer one, and an additional cover is inserted.

Theoretically, the foregoing oven may be constructed and used, but the commercial manufacture thereof presents certain difficulties arising from the need to disassemble the heating wall cover which envolves objectionably high capital cost. In addition, the major amount of combustion products flows through the lower portion of the flow port. Consequently, an adjustment of the port top edge position effects but insignifically the heating of the upper portion of the vertical heating flues. It should be noted that a change, e.g. a decrease in the flow port clear opening results in an increased hydraulic resistance of the port which disturbs hydraulic conditions of the coke oven heating system.

Disclosed in the Germany Pat. No. 1,671,325 and the Japan Pat. No. 46-20146 is a horizontal chamber coke oven which comprises a horizontal coking chamber confined between heating walls with vertical heating flues arranged in pairs. The upper portion of a partition separating adjoining vertical heating flues is formed with a main flow port and an additional one disposed higher with respect to the main flow port. Between said ports a crosspiece of the vertical heating flues is positioned. The crosspiece is formed with an additional flue which is an extension of one of the vertical heating flues but has a lesser clear opening as compared to that of the main flow. The upper portion of the additional flue is provided with a gate for closing this flue at intervals.

According to the above invention the heating level of a coke oven is adjusted by passing some portion of combustion products through the additional flue and flow port from one vertical heating flue to the other. However, the major volume of combustion products takes the shortest course, i.e. flows through the main flow port. Therefore only a negligible quantity of combustion products may pass through the additional flow port, which cannot substantially help in adjusting the temperature in the upper portion of heating flues and hence, in controlling the coke cake heating. Besides, the crosspiece in the upper portion of vertical heating flues creates a hydraulic resistance and decreases heat transfer from the upper portion of the vertical heating flue walls to the coal charge.

Another prior art coke oven comprising a horizontal coking chamber confined between heating walls having vertical heating flues arranged in pairs is disclosed in the German Pat. No. 1671319, in the U.S. Pat. No. 3,519,541, and in the Japan Pat. No. 46-23496. The upper portion of a partition separating adjoining vertical heating flues is provided with two flow ports arranged one above the other. The walls of the vertical heating flues are formed with rectangular pockets in the port location areas, slide gates being mounted on the shoulders of said pockets for reciprocating motion to close alternately one or the other flow port.

The level of heating in the foregoing coke oven is adjusted as follows. When the lower flow port is closed and the upper one is open, combustion products flow from one vertical flue to the other through the upper port and vice versa when the position of the slide gates is reversed. By changing the position of the slide gates it is possible to control the temperature within the upper portion of the vertical heating flues and, accordingly, the temperature in the coking chamber upper portion. The provision of rectangular pockets with the slide gates within the vertical heating flues leads, however, to a considerably increased hydraulic resistance to gas flow. In addition heat transfer to the coking chamber decreases in the area where the slide gates abut upon the walls of the vertical heating flues. It is to be noted that two flow ports having a requisite clear opening occupy a substantial portion of the vertical extent of the partition separating adjoining vertical flues which practically rules out any possibility to control the heating, for shrinkage of different coal charges varies within a considerably narrower range.

Another prior art heating wall of a coke oven with a horizontal coking chamber comprises vertical heating flues arranged in pairs, every pair being separated by a partition formed in its upper portion with a flow port which is provided with slotlike guides for mounting an extensible slide gate incorporating means for introducing the hook of a rod and displacing the slide gate.

The slot-like guides are horizontally mounted on shoulders adjoining the upper and the lower edges, respectively, of the flow port and projecting inwardly within the vertical heating flue. Another flow port is formed in the partition above the aforesaid flow port. A projection extends horizontally along the entire inner diameter of the vertical heating flue between the flow ports and forms a horizontal aperture. This projection serves as a guide and horizontally mounts an extensible slide gate (the USSR Inventor's Certificate No. 57767) Int. Class Cl0v 5/02.

The temperature within the upper portion of the coking chamber is adjusted as follows. If the temperature in the upper portion of the coking chamber is to be raised, combustion products are passed from one vertical heating flue into the other through the upper flow port. In so doing, the lower flow port is closed by the extensible slide gate, the horizontal aperture formed by the horizontally extending projection is open, and vice versa.

Extensible slide gates are more light-weight as compared to non-extensible ones, which makes them easier to move and therefore facilitates the temperature control within the upper portion of the coking chamber. However, the foregoing heating wall is characterized by certain short-comings, some of them being identical to those of prior art coke ovens with heating walls in which the flow port clear opening is closed by slide gates whereas some other being intrinstic in the construction of the heating wall being described.

Thus, the shoulders and projection inside the vertical heating flue substantially increase the hydraulic resistance to the combustion products flow and decrease the active surface of heat transfer from the walls to the coal charge. It is common knowledge, however, that the vertical heating flue must have an unobstructed cross-section and a minimum hydraulic resistance along the full vertical extent, i.e. the flue walls should have no swellings or projections with refractory members positioned thereon. Besides, as the upper or lower flow port is opened to provide for combustion products flow at an appropriate level, the slide gates are driven towards the walls of the vertical heating flues, so that they cover a portion of the wall surface, which results in deterioration of heat transfer into the coking chamber in this area.

It is an object of the invention to provide a coke oven heating wall which allows for temperature to be changed in the upper portion of the coke chamber according to changes in coal charge shrinkage.

Another object of the invention is to provide a heating wall having a flow port in a partition separating adjoining vertical flues arranged in pairs of such a design which allows the vertical position of the flow port to be changed without changing the clear opening area of the flow part or the clear opening of the vertical heating flues along their full vertical extent.

A further object of the invention is to provide a coke oven heating wall which affords temperature control in the upper portion of the coking chamber, necessary for the appropriate heating of the coke cake upper portion in order to improve the coke quality.

SUMMARY OF THE INVENTION

To achieve the foregoing and other objects, in a heating wall of a horizontal chamber coke oven which includes vertical heating flues arranged in pairs, each pair of the flues being separated by a partition formed with a flow port in the upper portion thereof which flow port is provided with slot-like guides for movably mounting a slide gate incorporating means for introducing a hook to displace the slide gate in order to regulate the temperature within the upper portion of the wall heating flues according to the invention lateral sides of the slide gate are provided with projections inserted into guides which extend vertically along the vertical walls of the flow port, the upper portion of each guide being formed with a stepped recess the vertical extent of which exceeds the length of the slide gate projections, and the slide gate centre of gravity being shifted relatively to the longitudinal axis of the projections in the direction opposite to the stepped recesses for the slide gate to be swung and held by gravity in its uppermost position in the flow port in order to change the vertical position of the flow port substantially without changing its clear opening area.

A coke oven heating wall of such a design affords, as compared to prior art, a possibility to change the temperature within the coking chamber upper portion by moving the slide gate into the uppermost or lowermost position in the flow port. This makes it possible to coke differently shrinking coal charges, i.e. coals of various grades. As the slot-like guides with the slide gate movably mounted therein are arranged vertically, the vertical heating flues are free of inside swellings or projections which increase hydraulic resistance and decrease heat transfer from the walls. Coke quality is improved due to a possibility of controlling temperature within the coking chamber upper portion to provide necessary heating conditions for the coke cake.

It is advisable that the slide gate having the centre of gravity shifted in the direction opposite to the stepped recesses in the guides be provided with means for introducing a hook of a rod formed as at least one through conical opening necking in the direction opposite to that in which the slide gate centre of gravity is shifted to provide for its swinging in a vertical plane in the rod hook.

It is desirable that the slide gate having the centre of gravity shifted in the direction opposite to the stepped recesses in the the means for introducing a hook of a rod be formed as a stepped recess in the slide gate side opposite to the direction in which the gate assembly centre of gravity is shifted, the stepped recess top being inversely inclined to the horizontal to provide for the slide gate swinging in a vertical plane.

BRIEF DESCRIPTION OF THE DRAWINGS

The foregoing and other objects of the present invention will become more apparent from a detailed description of embodiments thereof with reference to the accompanying drawings in which like reference numerals denote respective parts throughout several views and in which.

DESCRIPTION OF PREFERRED EMBODIMENTS OF THE INVENTION

Figure 1:
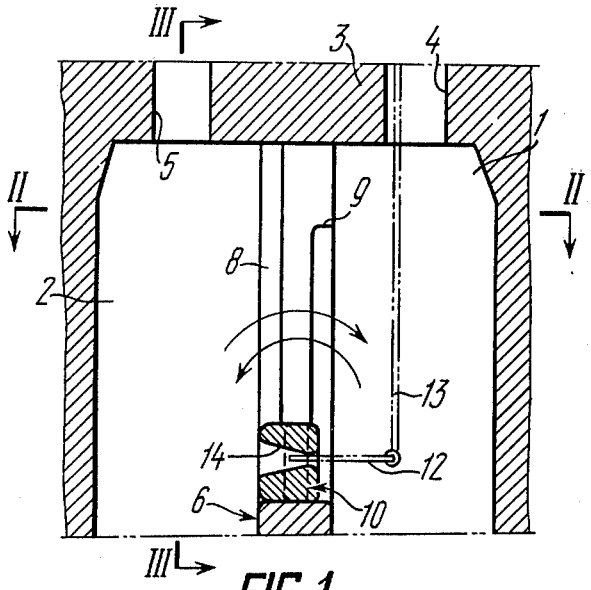
FIG. 1 is a fragmentary cross-sectional view of a heating wall, namely, the upper portion of adjoining vertical heating flues separated by a partition the flow port of which is formed with slot-like guides provided with a stepped recess.
Figure 2:
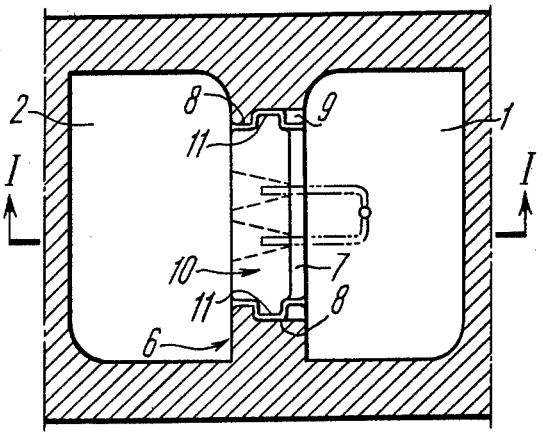
FIG. 2 is a cross-section taken along the line II—II in FIG. 1 and showing clear openings of ajoining vertical heating flues and a slide gate mounted in slot-like guides.
Figure 3:
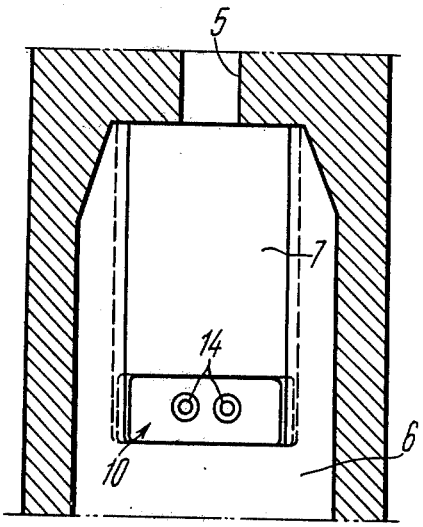
FIG. 3 is a cross-section taken along the line III—III in FIG. 1 and showing a flow port with a slide gate in the lowermost position.

A coke oven includes a horizontal coking chamber (not shown) confined between heating walls (FIG. 1). The heating wall incorporates paired vertical heating flues 1 and 2 (FIG. 1) with a cover 3 provided with passages 4 and 5. Every pair of adjoining vertical heating flues 1 and 2 (FIG. 1) is separated by a partition 6 formed with a flow port 7 in the upper portion. The lateral sides of the flow port 7 (FIG. 2) are provided with vertical slot-like guides 8 having stepped recesses 9 in the upper portion. A slide gate 10 is mounted in the guides 8. Lateral sides of the slide gate 10 are formed with projections 11 (FIGS. 2 and 3) which are inserted into the slots of the guides 8 and the length of the projections 11 being less than the vertical extent of the stepped recesses 9 in the guides 8. The centre C of gravity of the slide gate 10 is shifted relative to the longitudinal axis of the projections 11. The slide gate 10 is formed with means for introducing a hook 12 of a rod 13 to displace the slide gate.

Figure 4:
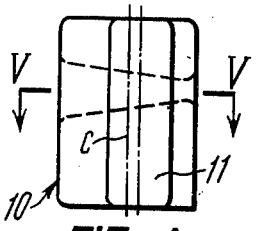
FIG. 4 shows a slide gate formed with two conical openings for introducing a hook, lateral view.
Figure 5:
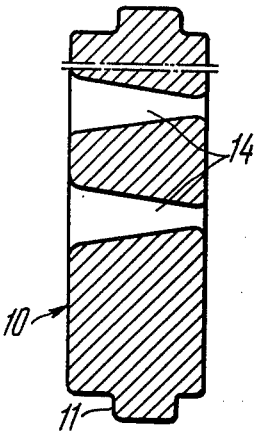
FIG. 5 is a cross-section taken along the line V—V in FIG. 4.

FIGS. 4 and 5 show an embodiment of the slide gate 10 having the means for introducing the hook 12 of a rod 13 (FIGS. 4, 5) formed as two through conical openings 14 necking in the direction opposite to that in which the slide gate centre C of gravity is shifted to provide for the slide gate 10 swinging in a vertical plane on the hook 12 of the rod 13.

Figure 6:
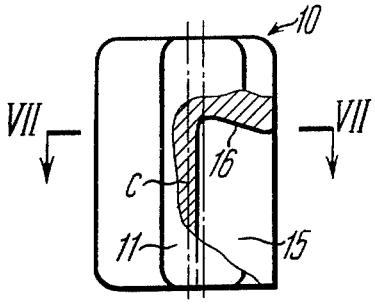
FIG. 6 is a slide gate, partly in section to show a stepped recess formed therein for introducing a hook, lateral view.
Figure 7:
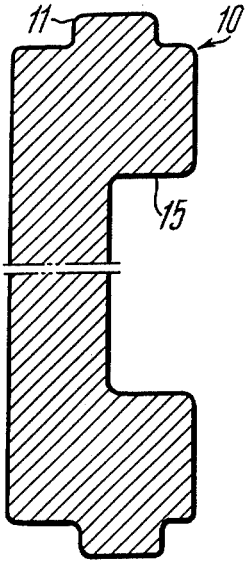
FIG. 7 is a cross-section taken along the line VII—VII in FIG. 6.

FIGS. 6 and 7 show a further embodiment of the slide gate 10, wherein the means for introducing the hook 12 (FIG. 1) of the rod 13 is formed as a stepped recess 15 (FIG. 6) in the side which is farther from the centre C of gravity. The stepped recess top 16 is inversely tilted with respect to the horizontal to provide for swinging of the slide gate 10 in a vertical plane on the hook 12 of the rod 13.

The heating level, i.e. the distance from the coking chamber top (not shown) to the upper edge of the flow port 7 and, consequently, the temperature within the coking chamber upper portion, is adjusted as follows.

Figure 8:
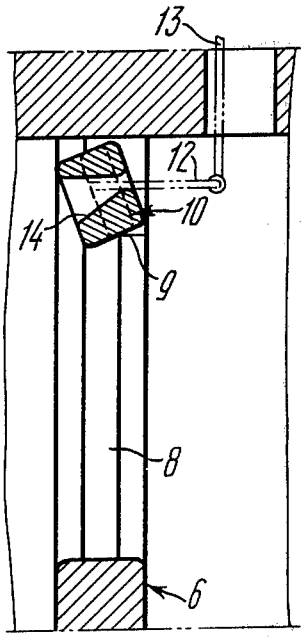
FIG. 8 is a cross-section through a flow port with a slide gate in the uppermost position.

When the coal charge shrinkage exceeds the rated level, i.e. the coke top level towards the end of coking will be below the rated one, the slide gate 10 is brought into the uppermost position. This is carried out in the following manner. The rod 13 with the hook 12 is lowered into the vertical heating flue 1 through the passage 4 (FIG. 1). The sister or single hook 12 is inserted into the through openings 14 or the stepped recess 15, respectively, of the slide gate 10. As the rod 13 moves upwards, the hook 12 draws the slide gate 10. As the bottom edges of the projections 11 of the slide gate 10 reach the edge of the stepped recesses 9 in the guides 8, the slide gate 10 is gravity swung in the vertical plane, the upper ends of the slide gate 10 projections 11 abutting against the guides 8 and the bottom edges of the projections 11 resting on the edges of the stepped recesses 9. The slide gate position in the guides 8 is fixed due to the shifted centre C of gravity (FIG. 8). The hook 12 is brought out of the slide gate 10, and the rod 13 removes said hook from the vertical heating flue 1 through the passage 4.

As a result, combustion products flow from one vertical heating flue 2 into the other 1 on a lower level proportionate to the slide gate height, and the temperature within the upper portion of the coking chamber (not shown) decreases. This, in turn, prevents the coke cake top and the coking chamber roof (both not shown) from overheating.

If the coal charge to be coked shrinks less than the preceding charge (which in practice is not infrequent), the slide gate 10 is lowered from its uppermost position in the flow port 8. This is carried out in the following manner. The rod 13 with the hook 12 is introduced into the vertical heating flue 2 through the passage 5. The hook 12 is brought under the slide gate 10 to lift the slide gate a little so that it occupies an upright position. Thereafter the hook 12 lowers the slide gate 10 until it rests on the bottom of the flow port 7 (FIG. 1). The hook 12 is brought out from under the slide gate 10 and is removed by the rod 13 from the vertical heating flue 2 through the passage 5. When the slide gate 10 rests on the bottom of the flow port 7, the bottom edge level of the flow port 7 is raised by the slide gate 10 height. Thus, combustion products flow from one vertical flue 2 to the other 1 on a higher level which is proportionate to the slide gate 10 height. As a result, the temperature within the upper portion of the coking chamber grows higher, and this, in turn, provides for a sufficient heating of the coke cake top and of the coking chamber roof (not shown).

As follows from the above description, by positioning the slide gate 10 at the top or at the bottom of the flow port 7 it is possible to change the vertical position of the flow port 7 by the slide gate height, the flow port clear opening remaining substantially unchanged. Furthermore, if the slide gate height is equal to 200 to 250 mm, the vertical position of the flow port 7 will be changed by the same value which, in turn, corresponds to the practical range of the coal charge shrinkage.

Thus, by changing the position of the slide gate it is possible to provide a requisite heating of the coke cake, i.e. to prevent it from overheating or underheating, and, consequently, to improve the quality of the coke produced.

To afford a better understanding of the essence of the invention, the heating wall in the above embodiments is represented by a pair of edjoining vertical heating flues. However it is obvious to those skilled in the art that the heating wall consists of a plurality of vertical heating flues arranged in pairs.

The embodiments of the present invention described herein-above are merely illustrative; it is evident that further modifications and adaptations thereof may be made without departing from the scope of the appended claims.

What is claimed is:

1. A heating wall for a coke oven with horizontal coking chambers comprising: vertical heating flues arranged in pairs; a partition separating the heating flues with each pair having an upper portion adjacent the top of each pair of heating flues; a flow port in the upper portion of said partition for combustion products to flow from one of said vertical flues into the other; vertical slot-like guides on opposite sides of said flow port; a slide gate whose vertical extent is less than that of the flow port and which is provided with projections to fit in a sliding manner into said slot-like guides; each slot-like guide having an upper portion on the same side in the form of a stepped recess to enable receipt of said projections; said slide gate having a center of gravity being shifted with respect to the central longitudinal axis of said projections in a direction opposite to said stepped recesses, the vertical extent of said stepped recesses exceeding that of the slide gate projections to provide for gravity swinging and fixing of said slide gate in an uppermost position in the flow port in order to change the vertical position of said flow port without substantially changing the area of the flow port, in said uppermost position said slider plate being obliquely disposed with lower and upper portions of said projections respectively contacting said stepped recesses and said slot-like guides; means in said slide gate for receiving a hook therein to permit displacement of said slide gate in said flow port; and means in each heating flue for inserting a hook therethrough to permit slide plate movement by said hook.

2. A heating wall according to claim 1, wherein said means for receiving said hook in said slide gate is at least one through conical opening necking in the direction opposite to that in which the slide gate center of gravity is shifted for swinging of the slide gate on said hook.

3. A heatng wall according to claim 1, wherein said means for receiving said hook in said slide gate is a stepped recess formed in the slide gate side opposite to the direction in which the slide gate center of gravity is shifted, said stepped recess having a top step inclined downwardly in said opposite direction for swinging of the slide gate on said hook into said uppermost position.

* * * * *